US010343701B2

(12) United States Patent
Coston et al.

(10) Patent No.: US 10,343,701 B2
(45) Date of Patent: Jul. 9, 2019

(54) RAILCAR SECURITY SYSTEM WITH CAR LIGHTING

(71) Applicant: Trinity North American Freight Car, Inc., Dallas, TX (US)

(72) Inventors: Kyle R. Coston, Forney, TX (US); Hiten Y. Mehta, Frisco, TX (US); Brant R. McGhee, Arlington, TX (US); Caglar Ozerdim, Dallas, TX (US); Victor M. Mankarious, Euless, TX (US); Christopher C. Harkey, Dallas, TX (US); Kenneth W. Huck, Fairview, TX (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 340 days.

(21) Appl. No.: 15/419,481

(22) Filed: Jan. 30, 2017

(65) Prior Publication Data

US 2017/0217455 A1 Aug. 3, 2017

Related U.S. Application Data

(60) Provisional application No. 62/289,637, filed on Feb. 1, 2016, provisional application No. 62/321,956, filed on Apr. 13, 2016.

(51) Int. Cl.

| | |
|---|---|
| ***G08B 19/00*** | (2006.01) |
| ***B61L 15/00*** | (2006.01) |
| ***B61L 25/02*** | (2006.01) |

(52) U.S. Cl.

CPC ..... *B61L 15/009* (2013.01); *B61L 15/0081* (2013.01); *B61L 25/025* (2013.01); *G08B 19/005* (2013.01); *B61L 2205/04* (2013.01)

(58) Field of Classification Search

CPC .. B61L 25/025; B61L 15/0081; B61L 15/009; B61L 17/00; B61L 17/02;

(Continued)

(56) References Cited

U.S. PATENT DOCUMENTS 7,755,660 B2 * 7/2010 Nejikovsky ..... B61K 9/08 348/135
8,380,361 B2 * 2/2013 Evans ..... B61L 17/00 246/14

(Continued)

*Primary Examiner* — Daniel Previl
(74) *Attorney, Agent, or Firm* — Baker Botts, LLP

(57) ABSTRACT

A railcar security system that includes a railcar, a first sensor having a first sensor type and a first sensor location with respect to the railcar, a second sensor having a second sensor type and a second sensor location with respect to the railcar, a first lighting group linked with the first sensor, a second lighting group linked with the second sensor, and a controller. The controller is configured to receive an arming signal, receive a trigger signal indicating a sensor of the plurality of sensors has been triggered, determine a sensor type and a sensor location for the sensor based on the trigger signal, activate the first lighting group when the determined sensor type and the determined sensor location correspond with the first sensor, and activate the second lighting group when the determined sensor type and the determined sensor location correspond with the second sensor.

20 Claims, 6 Drawing Sheets

(58) Field of Classification Search
CPC .. B61L 2205/04; B61L 23/007; B61L 25/021; B61L 25/023; B61L 27/0005; B67D 7/342; G01N 21/59; G01N 21/645; G01N 21/8507; G01N 2201/062; G01N 2201/12; G01N 33/22; G08B 19/005
USPC ..... 340/521, 531, 539.11, 539.13, 500, 540, 340/568.1, 571, 539.26
See application file for complete search history.

(56) References Cited

U.S. PATENT DOCUMENTS

| | | | | |
|---|---|---|---|---|
| 2009/0001226 | A1* | 1/2009 | Haygood | B61K 9/00 246/169 S |
| 2013/0054158 | A1* | 2/2013 | Toms | G01G 19/042 702/50 |
| 2016/0144777 | A1* | 5/2016 | Carpenter | B60Q 1/26 340/471 |

* cited by examiner

RAILCAR SECURITY SYSTEM WITH CAR LIGHTING

CROSS-REFERENCE TO RELATED APPLICATIONS

The present application claims benefit of U.S. Provisional Patent Application No. 62/289,637 filed Feb. 1, 2016 by Victor Mankarious, et al., and entitled "AUTORACK CAR LIGHTING AND SECURITY LIGHTS," and U.S. Provisional Patent Application No. 62/321,956 filed Apr. 13, 2016 by Kyle R. Coston, et al., and entitled "Auto Rack Car Lighting and Security System," which are both incorporated herein by reference as if reproduced in their entirety.

TECHNICAL FIELD

This disclosure relates generally to providing a security system for a railcar.

BACKGROUND

Railcars are susceptible to unlawful entries when entry doors are left open when they should be closed, or by forcible entry. Unlawful entries typically results in damage to vehicles being transported and/or parts being stolen. Unlawful entries may also result in the railcar being stolen. Railcars typically do not have an interlock system that prevents the railcar from moving while an entry door is open. Entry doors may be damaged and/or may hit and injure ground personnel if entry doors are left open while the railcar is moving. Thus, it is desirable to provide security to protect a railcar and its contents.

Loading and unloading a railcar such as an autorack car can be challenging due to limited light conditions. For example, the enclosure structure of the autorack car may only allow a limited amount of light in during the daytime. At night, outside floodlights may be used, however, the effectiveness of the floodlights is limited based on the arrangement of the floodlights. The headlights on vehicles being loaded into an autorack car are sometime used, however the direction of the headlights does not light up work areas such as areas where chocks are installed. In some instances, individual workers may wear portable lights, such as a miner style hat, to provide sufficient light to specific locations. Wearable lighting may use small batteries and may have limited usage times due to the relative short lifetime of the small batteries. Thus, it is desirable to provide a flexible lighting solution for railcars.

SUMMARY

In one embodiment, the disclosure includes a railcar security system that includes a railcar, a plurality of sensors disposed on the railcar, a plurality of lighting groups disposed on the railcar, and a controller disposed on the railcar. The plurality of sensors include a first sensor having a first sensor type and a first sensor location with respect to the railcar and a second sensor having a second sensor type and a second sensor location with respect to the railcar. The plurality of lighting groups includes a first lighting group linked with the first sensor and a second lighting group linked with the second sensor. The controller is operably coupled to the plurality of sensors and the plurality of lighting groups. The controller is configured to receive an arming signal indicating to monitor signals from the plurality of sensors and receive a trigger signal indicating a sensor of the plurality of sensors has been triggered. The controller is further configured to determine a sensor type for the sensor based on the trigger signal in response to receiving the trigger signal and determine a sensor location for the sensor based on the trigger signal in response to receiving the trigger signal. The controller is further configured to compare the determined sensor type to the first sensor type and the second sensor type and compare the determined sensor location to the first sensor location and the second sensor location. The controller is further configured to activate the first lighting group when the determined sensor type is the same as the first sensor type and the determined sensor location is the same as the first sensor location and activate the second lighting group when the determined sensor type is the same as the second sensor type and the determined sensor location is the same as the second sensor location.

In another embodiment, the disclosure includes a railcar security method that includes receiving an arming signal indicating to monitor signals from a plurality of sensors disposed on a railcar and receiving a trigger signal indicating a sensor of the plurality of sensors has been triggered. The method further includes determining a sensor type for the sensor based on the trigger signal in response to receiving the trigger signal and determining a sensor location for the sensor based on the trigger signal in response to receiving the trigger signal. The sensor location indicates the location of the sensor with respect to the railcar. The method further includes comparing the determined sensor type to a first sensor type of a first sensor from the plurality of sensors and a second sensor type of a second sensor from the plurality of sensors and comparing the determined sensor location to a first sensor location of the first sensor and a second sensor location of the second sensor. The method further includes activating a first lighting group linked with the first sensor from a plurality of lighting groups disposed on the railcar when the determined sensor type is the same as the first sensor type and the determined sensor location is the same as the first sensor location and activating a second lighting group linked with the second sensor from the plurality of lighting groups disposed on the railcar when the determined sensor type is the same as the second sensor type and the determined sensor location is the same as the second sensor location.

In yet another embodiment, the disclosure includes an apparatus that includes a plurality of sensors configured to be disposed on a railcar, a plurality of lighting groups configured to be disposed on the railcar, and a controller operably coupled to the plurality of sensors and the plurality of lighting groups. The plurality of sensors includes a first sensor having a first sensor type and a first sensor location with respect to the railcar and a second sensor having a second sensor type and a second sensor location with respect to the railcar. The plurality of lighting groups includes a first lighting group linked with the first sensor and a second lighting group linked with the second sensor. The controller is configured to receive an arming signal indicating to monitor signals from the plurality of sensors and receive a trigger signal indicating a sensor of the plurality of sensors has been triggered. The controller is further configured to determine a sensor type for the sensor based on the trigger signal in response to receiving the trigger signal and determine a sensor location for the sensor based on the trigger signal in response to receiving the trigger signal. The controller is further configured to compare the determined sensor type to the first sensor type and the second sensor type and compare the determined sensor location to the first sensor location and the second sensor location. The controller is further configured to activate the first lighting group when the determined sensor type is the same as the first sensor type and the determined sensor location is the same as the first sensor location and activate the second lighting group when the determined sensor type is the same as the second sensor type and the determined sensor location is the same as the second sensor location.

Various embodiments present several technical advantages, such as providing a railcar security system that provides various security features for protecting a railcar and its contents. The railcar security system is configured to detect and protect a railcar from conditions such as a door opening, a linkage disconnection, smoke, fire, an intrusion, fluid spills, and/or gas leaks while the railcar is in transport. The railcar security system may also provide light to work areas such as areas where tie down chocks are attached to the wheels of vehicles on the railcar or any other areas of the railcar. The railcar security system provided energy efficient features such as ensuring that lights are not left on after work on the railcar is complete and detecting ambient light levels to keeps lights off if sufficient interior light is available.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments of a railcar security system for a railcar such as a box car or autorack cars. In one embodiment, the railcar security system may provide various security features for protecting a railcar and its contents. For example, the railcar security system may be employed to reduce unlawful intrusions and/or to reduce vandalism. Various types of sensors may be employed by the railcar security system to detect unwanted intrusions into the railcar or to provide an alert when abnormal conditions, such as an open entry door, are detected. The railcar security system may be configured to trigger audible alarms, lights, and/or send wireless signals to alert the appropriate personnel in response to detecting an abnormal condition. Examples of abnormal conditions include, but are not limited to, a door opening, a linkage disconnection, smoke, fire, an intrusion, fluid spills, and gas leaks.

In some embodiments, the railcar security system may provide light to various work areas of a railcar. For example, the autorack security system may be configured to provide illumination for driving vehicles into and out of a railcar (e.g. an autorack). The railcar security system may also be configured to provide light to work areas such as areas where tie down chocks are attached to the wheels of vehicles on the railcar or any other areas of the railcar. The railcar security system may also be configured to be energy efficient by ensuring that lights are not left on after work on the railcar is complete. For example, the railcar security system may be configured to activate lights using ultrasonic and/or infrared detection of workers and to turn off the lights when workers are not present. In some embodiments, the railcar security system may also be configured to use light sensors to detect ambient light levels to keeps lights off if sufficient interior light is available.

Figure 1:
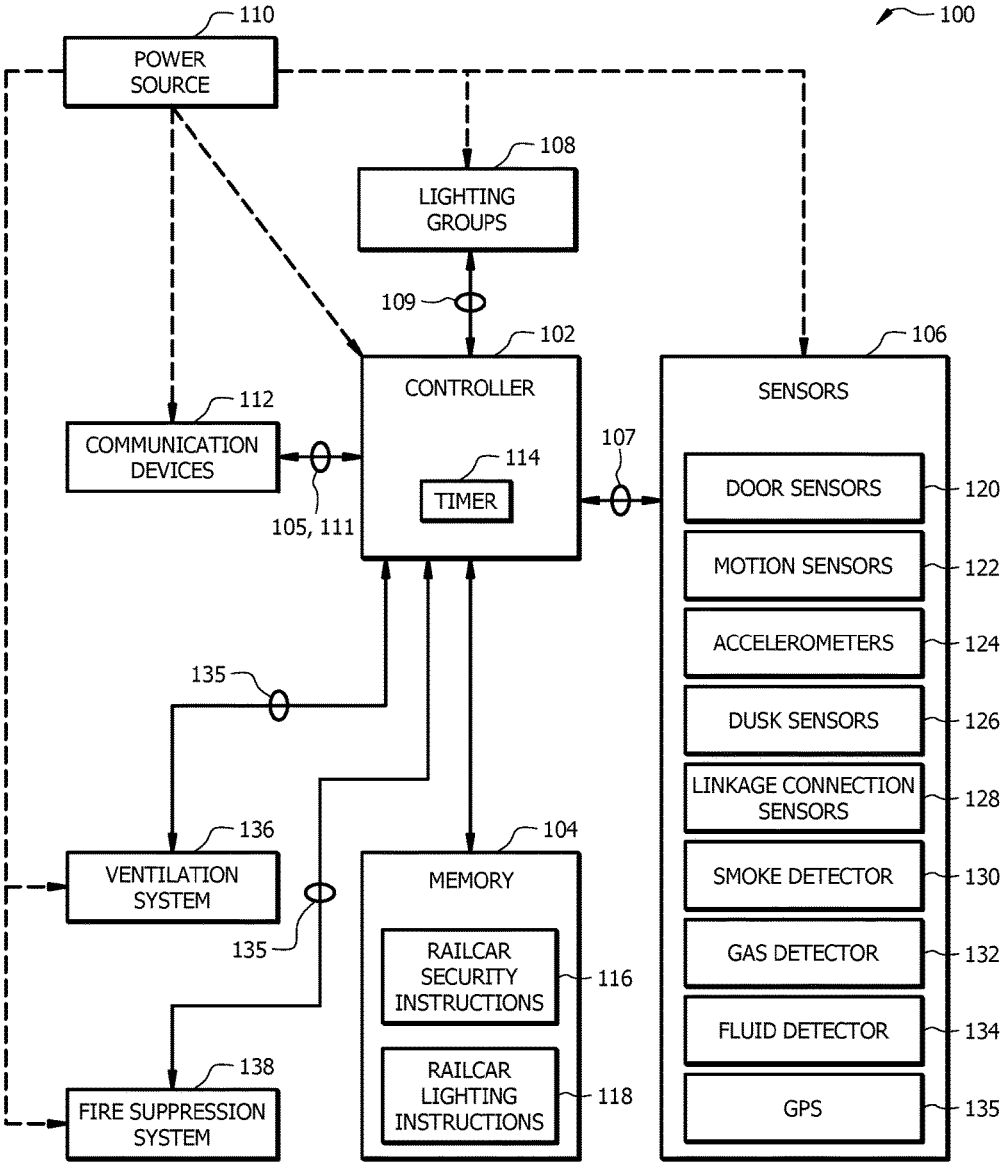
FIG. 1 is schematic diagram of a railcar security system for a railcar.

FIG. 1 is schematic diagram of a railcar security system 100 for a railcar. In one embodiment, the railcar security system 100 comprises a controller 102, a memory 104, one or more sensors 106, one or more lighting groups 108, a power source 110, and communication devices 112. The railcar security system 100 may be configured as shown or in any other suitable configuration or combination of components as would be appreciated by one of ordinary skill in the art upon viewing this disclosure. The railcar security system 100 may be integrated with any railcar structures including, but not limited to, box cars, grain cars, and autoracks cars. In one embodiment, the railcar security system 100 may be integrated with a railcar as a retrofit kit without requiring major modifications to the structure of the railcar. The railcar security system 100 may also be removable and/or reconfigurable once installed onto a railcar. In one embodiment, the railcar security system 100 may be configured to operate as a standalone system for a single railcar. In other embodiments, the railcar security system 100 may be configured to operating cooperatively with railcar security systems 100 on other railcars to form a network.

The controller 102 may be implemented as one or more central processing unit (CPU) chips, logic units, cores (e.g. a multi-core processor), field-programmable gate array (FPGAs), application specific integrated circuits (ASICs), or digital signal processors (DSPs). The controller 102 is communicatively coupled to and in signal communication with the memory 104, the one or more sensors 106, the one or more lighting groups 108, the power source 110, and the communication devices 112. The controller 102 is configured to receive and transmit electrical signals among one or more of the memory 104, the one or more sensors 106, the one or more lighting groups 108, the power source 110, and the communication devices 112. The electrical signals may be used to send and receive data or to control other devices. For example, the controller 102 may be configured to receive arming signals 105 from the communication devices 112 and/or other devices. The arming signal 105 may indicate for the controller 102 to arm the railcar security system 100 by activating one or more sensors 106 and/or by indicating for the controller 102 to monitor signals sent from the one or more sensors 106 for detecting abnormal conditions for the railcar. The controller 102 may also be configured to receive trigger signals 107 from the one or more sensors 106. The trigger signal 107 may indicate to the controller 102 that an abnormal condition has been detected. In some embodiments, the trigger signal 107 may comprise information or may indicate a sensor type of a sensor 106 sending the trigger signal 107 and/or a sensor location for the sensor 106 sending the trigger signal 107. In other embodiments, the controller 102 may be configured to determine a sensor type and/or a sensor location for a sensor 106 based on a pin, port, or any other suitable type of interface connection where a trigger signal 107 is received. For example, a motion sensor 122 located on the interior of a railcar may be signal communication with the controller 102 via an interface pin. When a trigger signal 107 is received at the interface pin in signal communication with the controller 102, the controller 102 may determine the sensor type is a motion sensor 122 and the sensor location is in the interior of the railcar. The controller 102 may also be configured to send an activation signal 109 to the one or more lighting groups 108 to activate (e.g. turn on) the one or more lighting groups 108. The controller 102 may also be configured to send an alert signal 111 to the communication devices 112. The alert signal 111 may be used to trigger an audible alarm and/or to notify the appropriate personnel that an abnormal condition has been detected. The controller 102 may also be configured to send a control signal 135 to a ventilation system 135 or a fire suppression system 138 that activates the ventilation system 135 or the fire suppression system 138. Additional details for the signals received and sent by the controller 102 are described below. In some embodiments, the controller 102 may be operably coupled to one or more other devices not shown. For example, the controller 102 may be operably coupled with a keypad configured to arm and disarm the railcar security system 100. As another example, the controller 102 may be operably coupled to a receiver or transceiver for a radio frequency (RF) signaling device (e.g. a key fob or automatic equipment identification (AEI) tags) configured send an arming signal 105 to the controller 102 to arm and disarm the railcar security system 100.

The controller 102 may be located on the interior or the exterior of a railcar. In some embodiments the railcar security system 100 may comprise multiple controllers 102. For example, the railcar security system 100 may comprise a first controller 102 located at a first end of a railcar and a second controller 102 located at a second end of the railcar. As another example, a first controller 102 may be located on the interior of a railcar and a second controller 102 may be located on the exterior of the railcar.

The controller 102 is configured to process data and may be implemented in hardware or software. The controller 102 may be configured to implement various instructions. For example, the controller 102 may be configured to implement railcar security instructions 116 and railcar lighting instructions 118. In FIG. 1, the railcar security instructions 116 and the railcar lighting instructions 118 are implemented as instructions (e.g. software code or firmware) stored in memory 104. In other embodiments, the railcar security instructions 116 and/or the railcar lighting instructions 118 may be implemented as instructions stored in the controller 102. The inclusions of the railcar security instructions 116 and/or the railcar lighting instructions 118 provide an improvement to the functionality of the railcar security system 100, which effects a transformation of the railcar security system 100 to a different state.

In one embodiment, the controller 102 may further comprise instructions for detecting battery charge levels and to signal when a battery charge level is getting low. The controller 102 may also comprise instructions for implementing battery charge saving schemes such as reducing a pulse width modulation rate, implementing staggered lighting or per deck lighting, or any other suitable methods to extend battery life and usage. The controller 102 may also comprise logic for selecting or switching between power sources 110. For example, the controller 102 may be configured to switch between battery power and an external power source when the railcar security system 100 is connected to an external power source. In one embodiment, the controller 102 may comprise instructions to use the external power source to charge on-board batteries when an external power source is available.

In one embodiment, the controller 102 may comprise a timer 114. Timer 114 is configured to indicate a time (e.g. a relative time or an absolute time), measure an amount of time elapsed, and/or measure an amount of time remaining (e.g. a countdown timer). In another embodiment, the timer 114 may be an external timer operably coupled to the controller 102. Examples of timer 114 include, but are not limited to, timer chips, crystal oscillators, hardware timers, and analog or digital clocks.

The memory 104 may comprise one or more disks, tape drives, or solid-state drives, and may be used as an over-flow data storage device, to store programs when such programs are selected for execution, and to store instructions and data that are read during program execution. The memory 104 may be volatile or non-volatile and may comprise read-only memory (ROM), random-access memory (RAM), ternary content-addressable memory (TCAM), dynamic random-access memory (DRAM), and static random-access memory (SRAM). The memory 104 is operable to store the railcar security instructions 116, the railcar lighting instructions 118, and/or any other data or instructions. The railcar security instructions 116 and the railcar lighting instructions 118 may be implemented by the controller 102 to execute instructions for providing security and lighting enhancements to a railcar. For example, the railcar security instructions 116 may configure the controller 102 to alert an operator when one or more sensors 106 detect intrusions into the railcar or other abnormal conditions such as a gas leak, a fluid leak, a fire, or the railcar disconnecting. The railcar security system 100 may be configured to turn on lights, strobe lights, activate a siren, or employ any other method for alerting an operator. Examples of executing the railcar security instructions 116 are described with respect to FIGS. 4 and 5. Executing the railcar lighting instructions 118 may configure the controller 102 to provide light to various work areas of a railcar. An example of executing the railcar lighting instructions 118 is described with respect to FIG. 6.

Sensors 106 may be operably coupled to the controller 102 and configured to provide data or electrical signals (e.g. trigger signals 107) to the controller 102. Sensors 106 may be configured to detect abnormal conditions such as intrusions, smoke, fire, and liquid spills. Examples of sensors 106 include, but are not limited to, door sensors 120, motion sensors 122, accelerometers 124, dusk sensors 126, linkage connection sensors 128, smoke detectors 130, gas detectors 132, fluid detectors 134, a global position system (GPS) sensor 135, light sensors, ultrasonic sensors, infrared sensors, glass break sensors, sound sensors, and contact sensors. For example, door sensors 120 may comprise contact switches or proximity sensors on an entry door of the railcar that are configured to send a trigger signal 107 based on whether the entry door is open or closed. Door sensors 120 may also be employed with a door or lid of a storage compartment within a railcar, for example, a key fob storage compartment, and may send a trigger signal 107 when the storage compartment is opened after arming the railcar security system 100. Motion sensors 122 may be configured to detect motion within the interior and/or the exterior of a railcar, for example, using ultrasonic sensors or infrared sensors, and to send a trigger signal 107 in response to detecting motion. Accelerometers 124 may be configured to detect whether a railcar is moving and the direction that the railcar is moving. Dusk sensors 126 may comprise a light sensor configured to detect ambient light levels, for example, whether its day time or night time. Dusk sensors 126 may be configured to send a trigger signal 107 when the ambient light falls below some predetermined threshold. For example, the dusk sensor 126 may send a trigger signal 107 when it's dark outside. Linkage connection sensors 128 may comprise a contact sensor configured to detect whether a railcar is connected or disconnected to another railcar or a tie down. For example, the linkage connection sensor 128 may be configured to send a trigger signal 107 when the railcar becomes disconnected from another railcar or a tie down. Smoke detectors 130 may be configured to detect smoke within the interior of a railcar and to send a trigger signal 107 in response to detecting smoke. Gas detectors 132 may be configured to detect gases (e.g. carbon monoxide) within the interior or a railcar and to send a trigger signal 107 in response to detecting a gas. Fluid detectors 134 may be configured to detect spilled fluids within the interior of a railcar and to send a trigger signal 107 in response to detecting a fluid. The GPS sensor 135 may be configured to provide geographic location information for a railcar. The railcar security system 100 may be configured with any other kinds of sensors 106 or combination of sensors 106 as would be appreciated by one of ordinary skill in the art upon viewing this disclosure.

A lighting group 108 may comprise one or more lights. Examples of lights include, but are not limited to, light emitting diodes (LEDs), incandescent lights, fluorescent lights, tungsten arc lights, halogen lights, fiber optic lights, or any other suitable type of lights. For example, a lighting group 108 may comprise a plurality of LEDs. Each lighting group 108 may be configured with any suitable number of lights (e.g. LEDs). The light output of each lighting group 108 may be adjustable or predetermine and set for a particular application. The railcar security system 100 may also be configured with any suitable number of lighting groups 108.

Lighting groups 108 may be used on the inside and/or the outside of a railcar. For example, one or more lighting groups 108 may be located within the interior of a railcar and one or more other lighting groups 108 may be located on an exterior surface of the railcar. Lighting groups 108 may be attached to surfaces of the railcar using permanent attachments, semi-permanent attachments, or removable attachments (e.g. magnets, Velcro, or clips). Lighting groups 108 located on the inside of a railcar may be distributed among interior surfaces of the railcar. For instance, a railcar may be configured with a number of lighting groups 108 on each side of the interior of a railcar. Lighting groups 108 may be positioned at any suitable level within the railcar. For example, lighting groups 108 may be positioned at floor level for each deck within a railcar. In one embodiment, lighting groups 108 may be positioned to provide light in areas where chocks are applied to the wheels of vehicles loaded on the railcar. Lighting groups 108 may be distributed or placed in any other suitable location on or in the railcar for illuminating ladders, hand grabs, bridge plate attachment locations, or any other locations as would be appreciated by one of ordinary skill in the art upon viewing this disclosure.

Lighting groups 108 may be configured to turn on, off, or flash in response to an activation signal 109 from the controller 102. Lighting groups 108 may be configured to remain on or to automatically turn off after a predetermined period of time after receiving an activation signal 109. Different lighting groups 108 may be configured to flash synchronously or asynchronously with each other. For example, a lighting group 108 on the interior of a railcar may be configured to flash synchronously with a lighting group 108 on the exterior of the railcar. In one embodiment, lighting groups 108 may be configured to turn off in response to a deactivation signal, for example, a signal from the controller 102 in response to a key fob or keypad command.

The communication devices 112 are operably coupled to the controller 102 and configured to provide wired and/or wireless communication capabilities to the railcar security system 100. Communication devices 112 may be configured to send arming signals 105 that indicate to arm the railcar security system 100 to the controller 102. Communication devices 112 may also be configured to receive alert signals 111 from the controller 102 in response to the detection of an abnormal condition. Communication devices 112 may comprise a transmitter, a receiver, and/or a transceiver for communicating with other devices. Communication devices 112 may be configured to employ any suitable communication technology and/or protocol such as a telecommunication network. Communication devices 112 may comprise any suitable communication devices as would be appreciated by one of ordinary skill in the art upon viewing this disclosure. In one embodiment, the communication device 112 may be employed to communicate with a wireless communication system to alert the locomotive crew about the status of the railcar and/or the present of abnormal conditions. For example, the controller 102 may sent an alert signal 111 to the communication device 112 to notify the locomotive crew about the presence of an abnormal condition.

In one embodiment, the railcar security system 100 may further comprise a ventilation system 136. The ventilation system 136 may be configured to receive a control signal 135 from the controller 102 that indicates to remove fumes or hot air from the interior of a railcar by bringing in outside air. For example, the controller 102 may send a control signal 135 to the ventilation system 136 that activates (e.g. turns on) the ventilation system 136 in response to receiving a trigger signal 107 from a smoke detector 130. The ventilation system 136 may comprise fans, vents, ducts, or any other equipment as would be appreciated by one of ordinary skill in the art upon viewing this disclosure.

In another embodiment, the railcar security system 100 may comprise a fire suppression system 138. The fire suppression system 138 may be configured to receive a control signal 135 from the controller that indicates to suppress fire, for example, by activating a sprinkler system. The fire suppression system 138 may comprise sprinklers, fire extinguishers, and/or any other suitable fire suppression equipment as would be appreciated by one of ordinary skill in the art upon viewing this disclosure.

The power source 110 may be operably coupled to the controller 102, one or more lighting groups 108, one or more sensors 106, communication devices 112, ventilation system 136, and/or fire suppression system 138. Examples of power sources 110 include, but are not limited to, on-board battery systems, solar panels, charged capacitors, on-board power generators that turn as the wheels of a railcar turn, wind power generator, a hand crank power generator, an air driven wrench power generator, power from the locomotive, an external DC power source, and an alternating current (AC) power source. For example, a hand crank or air driven wrench powered generator may be employed to charge batteries to a certain voltage level to power the railcar security system 100. As another example, an external AC power source may be employed to charge batteries or capacitors to a voltage level to power the railcar security system 100. The power source 110 is configured to provide power (e.g. electrical power) to devices couple to the power source 110. The power source 110 may be configured to provide power at any suitable power output and/or voltage level (e.g. 12 volts direct current (DC)). The railcar security system 100 may comprise one or more power sources 110. For example, the railcar security system 100 may comprise a first power source 110 to provide power to the controller 102 and a second power source 110 to provide power to one or more lighting groups 108. The power source 110 may be connected to one or more other railcars using physical connections or cables. For example, multiple railcars may be coupled together such that a power source 110 can be shared by the railcars, which may reduce the number of facility hookups used to charge or power the railcar security system 100.

Figure 2:
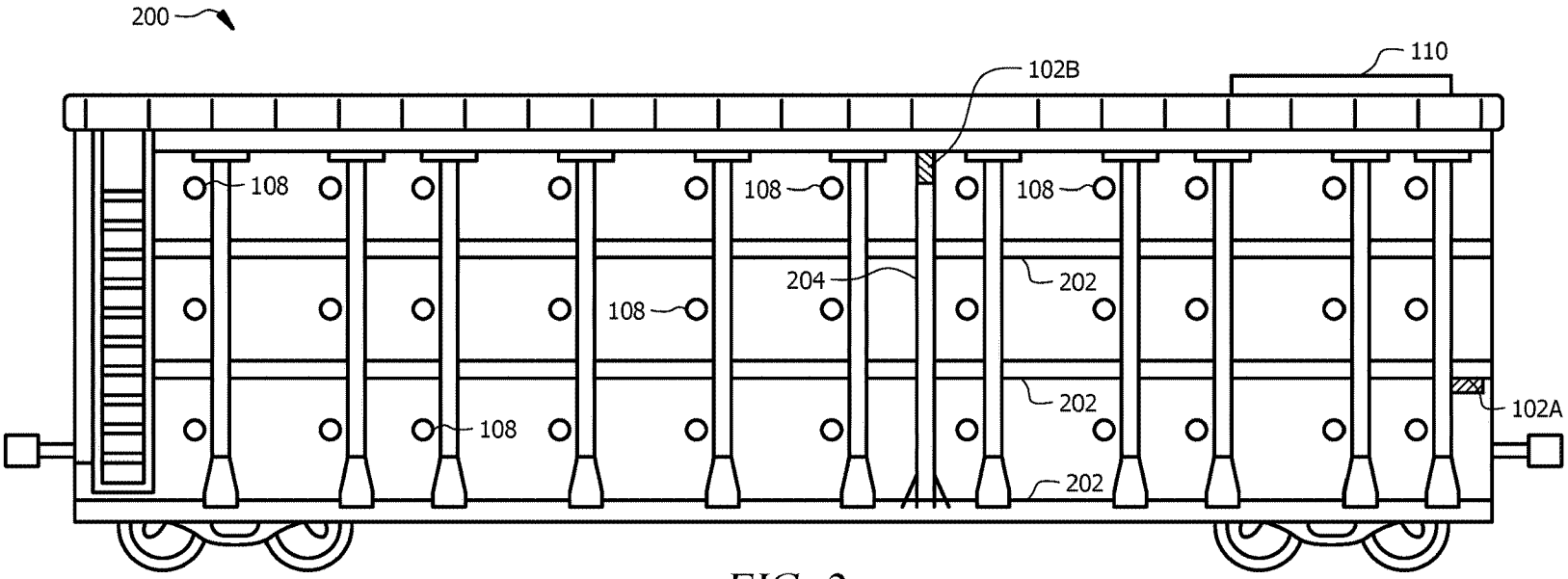
FIG. 2 is a partial cutaway side view of an embodiment of railcar employing the railcar security system.

FIG. 2 is a partial cutaway side view of an embodiment of railcar 200 employing the railcar security system 100. The railcar 200 comprises a plurality of lighting groups 108 distributed within the railcar 200. The lighting groups 108 are positioned to provide light to each deck 202 of the railcar 200. For example, each lighting group 108 may be positioned at a predetermined height (e.g. about 32 inches) above each deck 202. The lighting groups 108 may be positioned at any suitable height or location as would be appreciated by one of ordinary skill art upon viewing this disclosure. The lighting groups 108 may be positioned along the sides of the railcar 200 such that they are visible from either side of the railcar 200. The lighting groups 108 may be positioned as shown or in any other suitable configuration. The lighting groups 108 may be collectively or individually controlled by one or more controllers 102. The lighting groups 108 may each be powered by one or more power sources 110. As an example, a first controller 102A may be located near the entry doors of the railcar 200 and a second controller 102B may be located within a dummy post 204. The power source 110 may comprise a solar panel disposed on the roof of the railcar 200 which is configured to provide power to controllers 102 and to one or more of the lighting groups 108. Solar panels may be positioned on any exterior surface of the railcar 200.

Figure 3:
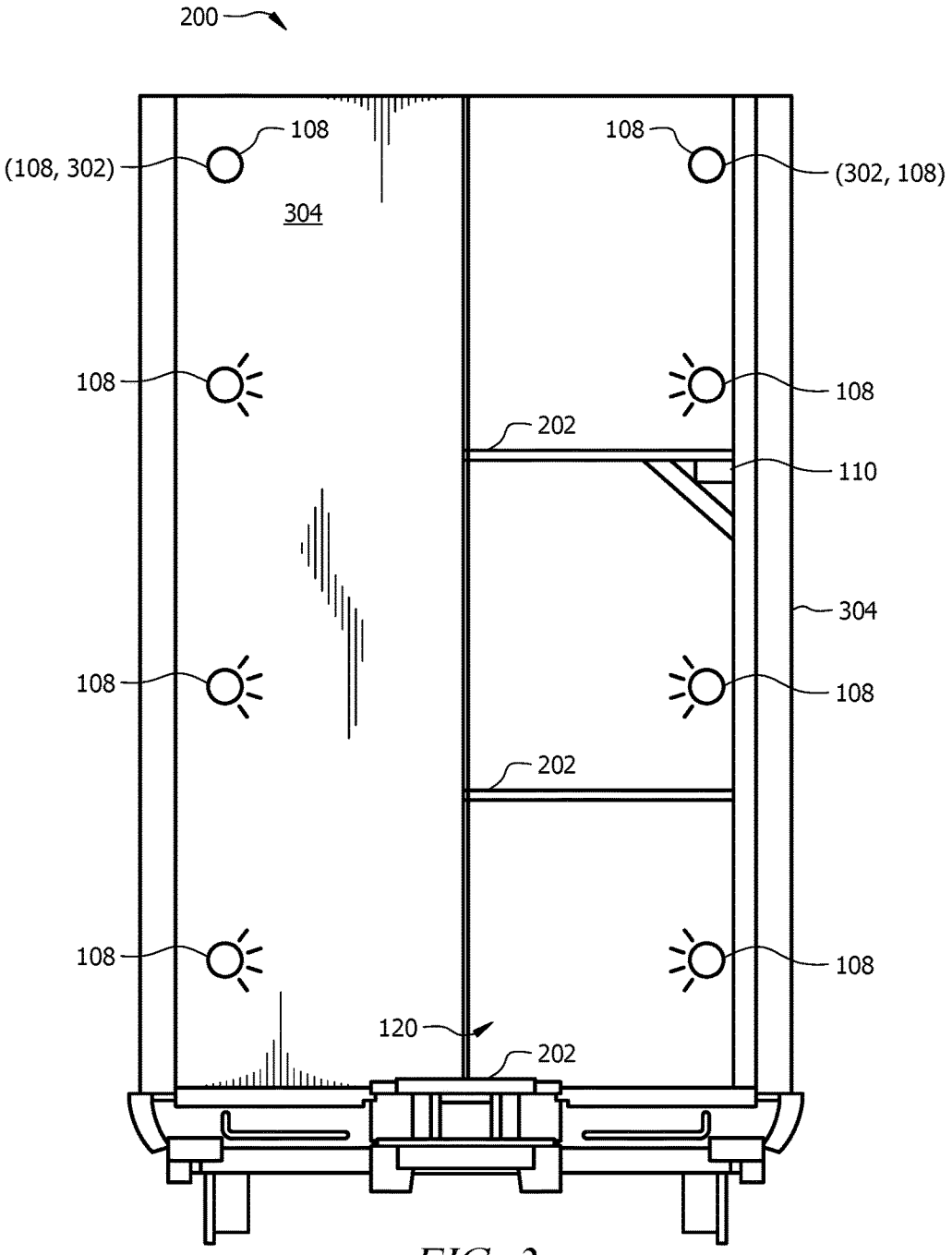
FIG. 3 is an end view of an embodiment of a railcar employing the railcar security system.

FIG. 3 is an end view of an embodiment of a railcar 200 employing the railcar security system 100. The railcar security system 100 may be configured to provide security lighting for the ends of the railcar 200, for example, the entry doors of the railcar 200. The railcar security system 100 may be configured to illuminate lighting groups 108 on the exterior (shown at locations 302) in response to detecting that either entry door 304 is opened using door sensor 120, for example, a proximity switch, a contact switch, or any other type of limit switch. The railcar security system 100 may also comprise lighting groups 108 inside of the railcar 200 to provide light to each deck 202 of the railcar 200. The lighting groups 108 may be positioned as shown or in any other suitable configuration. The power source 110 for the railcar security system 100 may comprise a battery in an enclosure that is located inside of the railcar 200.

Figure 4:
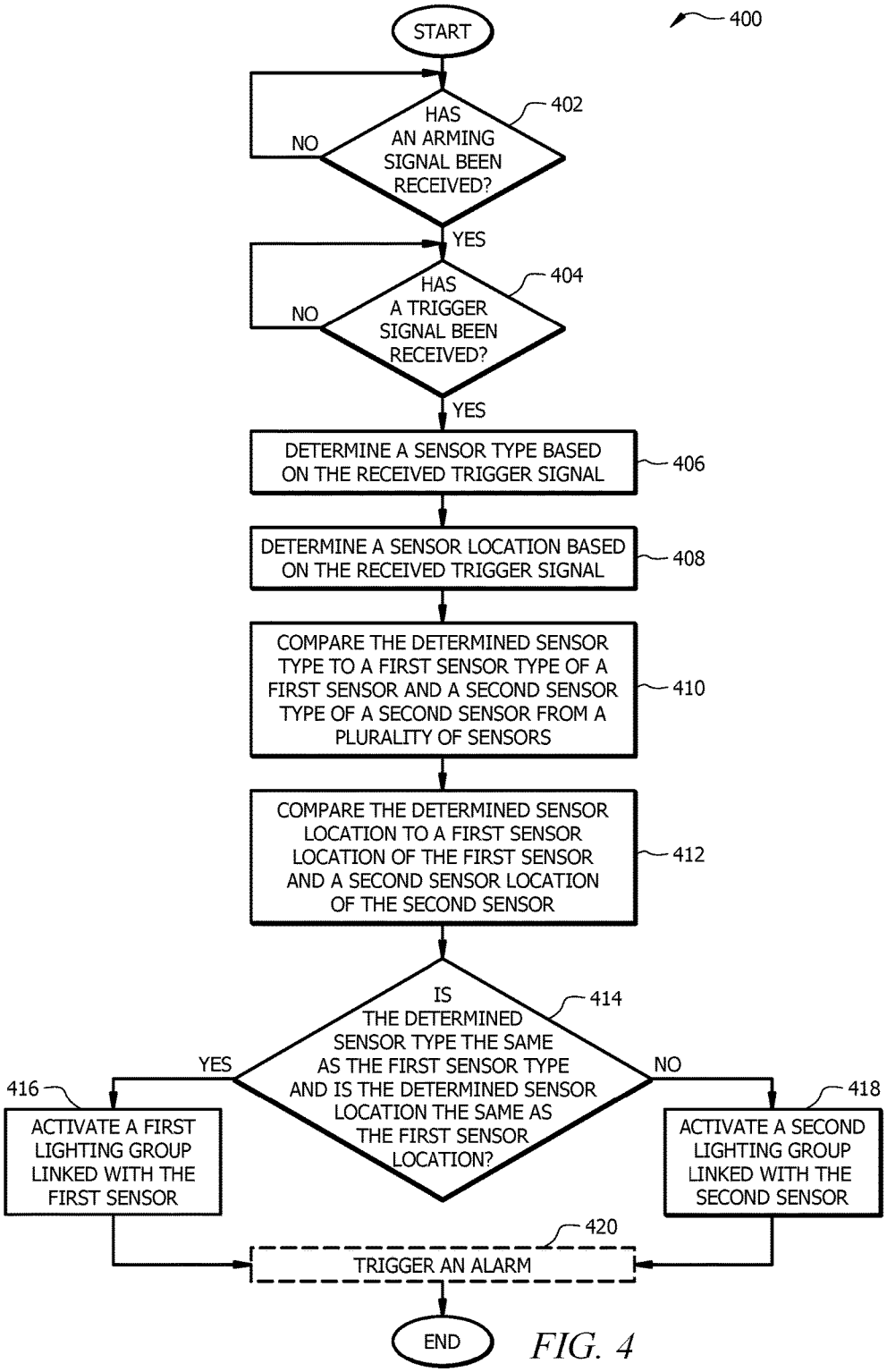
FIG. 4 is a flowchart of an embodiment of a railcar security method using the railcar security system.

FIG. 4 is a flowchart of an embodiment of a railcar security method 400 using the railcar security system 100. In an embodiment, the railcar security system 100 may employ method 400 to detect and record abnormal conditions for a railcar 200. For example, the railcar security system 100 may employ method 400 to detect abnormal conditions using one or more sensors 106 and to activate one or more lighting groups 108 based on the sensor type and/or the sensor location of the one or more sensors 106 detecting the abnormal conditions.

At step 402, the controller 102 determines whether an arming signal 105 has been received. The controller 102 arms the railcar security system 100 in response to receiving the arming signal 105. Arming the railcar security system 100 configures the railcar security system 100 for detecting abnormal conditions on the railcar 200 by activating one or more sensors 106 and/or by indicating for the controller 102 to monitor signals received from the one or more sensors 106. In one example, the controller 102 may receive an arming signal 105 from an operator using a wireless key fob. In other examples, the controller 102 may receive an arming signal 105 from an operator using an electronic keypad, an AEI tag-type system, or communication devices 112. The controller 102 may receive the arming signal 105 via any suitable device or mechanism as would be appreciated by one of ordinary skill in the art upon viewing this disclosure. The controller 102 proceeds to step 404 when the controller 102 determines that the controller 102 has received the arming signal 105. Otherwise, the controller 102 may continue to wait until the controller 102 receives the arming signal 105.

At step 404, the controller 102 determines whether a trigger signal 107 has been received from one or more of the sensors 106. For example, the controller 102 may determine that a trigger signal 107 has been received by a sensor 106 of the one or more sensors 106. The controller 102 may be configured to receive one or more trigger signals 107 from any of the one or more sensors 106 or any combination of the one or more sensors 106 in response to the detection of an abnormal condition. In one embodiment, the controller 102 may receive the trigger signal 107 from a door sensor 120 in response to a door of the railcar 200 being opened. In another embodiment, the controller 102 may receive the trigger signal 107 from a motion sensor 122 in response to a motion sensor 122 detecting motion within the interior of the railcar 200. In another embodiment, the controller 102 may receive the trigger signal 107 from a linkage connection sensor 128 in response to the linkage connection sensor 128 determining that the railcar 200 has become disconnected from another railcar. In another embodiment, the controller 102 may receive the trigger signal 107 from a smoke detector 130 in response to the smoke detector 130 determining that smoke is present within the interior of the railcar 200. In another embodiment, the controller 107 may receive the trigger signal 107 from a gas detector 132 in response to the gas detector 132 detecting gas within the interior of the railcar 200. In another embodiment, the controller 102 may receive the trigger signal 107 from a fluid detector 132 in response to the fluid detector 132 detecting a fluid (e.g. a fluid spill) within the interior of the railcar 200. The controller 102 proceeds to step 406 when the controller 102 determines that the controller 102 has received the trigger signal 107. In some embodiments, the controller 102 may be configured to receive more than one trigger signals 107 before proceeding to step 406. Otherwise, the controller 102 may continue to wait until the controller 102 receives the trigger signal 107.

At step 406, the controller 102 determines a sensor type for the sensor 106 sending the trigger signal 107 based on the received trigger signal 107. The sensor type indicates the type of sensor 106 sending the trigger signal 107. For example, the controller 102 may determine that the sensor type for the sensor 106 sending the triggering signal 107 corresponds with a door sensor 120, a motion sensor 122, a dusk sensor 126, a linkage connection sensor 128, a smoke detector 130, a gas detector 132, a fluid detector 134, or any other suitable kind of sensor 106. In one embodiment, the controller 102 may determine the sensor type for the sensor 106 based on information within the trigger signal 107 from the sensor 106 and/or based on an interface port or connection where the trigger signal 107 is received. In other embodiments, the sensor type for the sensor 106 may be determined using any other suitable techniques as would be appreciated by one of ordinary skill in the art upon viewing this disclosure.

At step 408, the controller 102 determines a sensor location for the sensor 106 sending the triggering signal 107 based on the received trigger signal 107. The sensor location indicates the location of the sensor 106 with respect to the railcar 200. For example, the sensor location may indicate whether the sensor 106 is located on the interior of the railcar 200, on the exterior of the railcar, proximate to a particular end door 304 of the railcar 200, proximate to a particular deck 202 of the railcar 200, or in any other suitable location on or in the railcar 200. In one embodiment, the controller 102 may determine the sensor location for the sensor 106 based on information within the trigger signal 107 from the sensor 106 and/or based on an interface port or connection where the trigger signal 107 is received. In other embodiments, the sensor location for the sensor 106 may be determined using any other suitable techniques as would be appreciated by one of ordinary skill in the art upon viewing this disclosure.

At step 410, the controller 102 compares the determined sensor type for the sensor 106 to a first sensor type of a first sensor 106 from the plurality of sensors 106 and to a second sensor type of a second sensor 106 from the plurality of sensors 106. The controller 102 may determine whether the determined sensor type for the sensor 106 is the same as the first sensor type of the first sensor 106 or the second sensor type of the second sensor 106. For example, if the first sensor 106 is a smoke detector 130 and the second sensor 106 is a door sensor 120, the controller 102 may determine whether the determined sensor type for the sensor 106 indicates that the sensor 106 is a smoke detector 130 or a door sensor 120.

At step 412, the controller 102 compares the determined sensor location for the sensor 106 to the first sensor location of a first sensor 106 and to the second sensor location of the second sensor 106. The controller 102 may determine whether the determined sensor location is the same as the first sensor location of the first sensor 106 or the second sensor location of the second sensor 106. For example, if the first sensor 106 is located in a central portion of the railcar 200 and the second sensor 106 is located at an end door 304 of the railcar 200, the controller 102 may determine whether the determined sensor location for the sensor 106 indicates that the sensor 106 is located in a central portion of the railcar or at an end door 304 of the railcar 200.

At step 414, the controller 102 proceeds to step 416 when the determined sensor type of the sensor 106 is the same as the first sensor type of the first sensor 106 and the determined sensor location of the sensor 106 is the same as the first sensor location of the first sensor 106. Otherwise, the controller 102 proceeds to step 418 when the determined sensor type of the sensor 106 is the same as the second sensor type of the second sensor 106 and the determined sensor location of the sensor 106 is the same as the second sensor location of the second sensor 106.

At step 416, the controller 102 activates a first lighting group 108 from a plurality of lighting groups 108 when the determined sensor type of the sensor 106 is the same as the first sensor type of the first sensor 106 and the determined sensor location of the sensor 106 is the same as the first sensor location of the first sensor 106. For example, the controller 102 may send an activation signal 109 to the first lighting group 108 on the interior and/or the exterior of the railcar 200 in response to determining the sensor 106 is a smoke detector 130 and determining the sensor 106 is located on the interior of the railcar 200. In this example, the controller 102 may activate the first lighting group 108 to indicate that smoke has been detected within the railcar 200. In one embodiment, the controller 102 may be further configured to activate the one or more other systems (e.g. fire suppression system 138 and/or ventilation system 136) in response to determining the sensor 106 is a smoke detector 130 and determining the sensor 106 is located on the interior of the railcar 200.

In another example, the controller 102 may send an activation signal 109 to the first lighting group 108 on the interior and/or the exterior of the railcar 200 in response to determining the sensor 106 is an occupancy sensor (e.g. a motion sensor 122) and determining the sensor 106 is located on the interior of the railcar 200 or proximate to a particular area (e.g. a deck 202) of the railcar 200. In this example, the controller 102 may active the first lighting group 108 to indicate someone has been detected moving within the interior of the railcar 200.

In another example, the controller 102 may send an activation signal 109 to the first lighting group 108 on the interior and/or the exterior of the railcar 200 in response to determining the sensor 106 is a gas detector 132 or a fluid detector 134 and determining the sensor 106 is located on the interior of the railcar 200. In this example, the controller 102 may active the first lighting group 108 to indicate that a gas leak or fluid spill has been detected within the interior of the railcar 200.

In another example, the controller 102 may send an activation signal 109 to the first lighting group 108 on the interior and/or the exterior of the railcar 200 in response to determining the sensor 106 is a door sensor 120 and determining the sensor 106 is located at a particular end door 304 of the railcar 200. In this example, the controller 102 may active the first lighting group 108 to indicate that a particular end door 304 of the railcar 200 has been opened.

In another example, the controller 102 may send an activation signal 109 to the first lighting group 108 on the interior and/or the exterior of the railcar 200 in response to determining the sensor 106 is a linkage connection sensor 128 and determining the sensor 106 is located at a particular linkage connection of the railcar 200. In this example, the controller 102 may active the first lighting group 108 to indicate that one of the linkage connections of the railcar 200 has become disconnected.

The first lighting groups 108 may activate (e.g. illuminate) in response to receiving the activation signal 109 from the controller 102. In one embodiment, the controller 102 may be configured to send an activation signal 109 that strobes or flashes the first lighting group 108. In one embodiment, the controller 102 may not activate one or more other lighting groups 108 while the first lighting group 108 is active. For example, the controller 102 may not activate a second lighting group 108 from the plurality of lighting groups 108 that is linked with the second sensor 106 when the first lighting group 108 is active.

At step 418, the controller 102 activates a second lighting group 108 from the plurality of lighting groups 108 when the determined sensor type of the sensor 106 is the same as the second sensor type of the second sensor 106 and the determined sensor location of the sensor 106 is the same as the second sensor location of the second sensor 106. Activating the second lighting group 108 may be performed similarly as described with respect to step 416.

Optionally at step 420, the controller 102 triggers an alarm in response the controller 102 receiving the trigger signal 107. For example, the controller 102 may send an alert signal 111 to trigger an alarm or notify personnel. In one embodiment, the alert signal 111 may be used to trigger an audible alarm or siren. In another embodiment, the alert signal 111 may be used to trigger the communication devices 112 to send a signal (e.g. wireless signal) or message to personnel. For instance, the communication devices 112 may send a signal to a control panel that notifies personal that an abnormal condition has been detected. In an embodiment, the controller 102 may be configured to record abnormal conditions. For example, the controller 102 may set and store status codes or an identifiers that identify the abnormal conditions that were detected. The controller 102 may also record the location of the railcar using the GPS sensor 135 and/or time of the detected abnormal condition.

Figure 5:
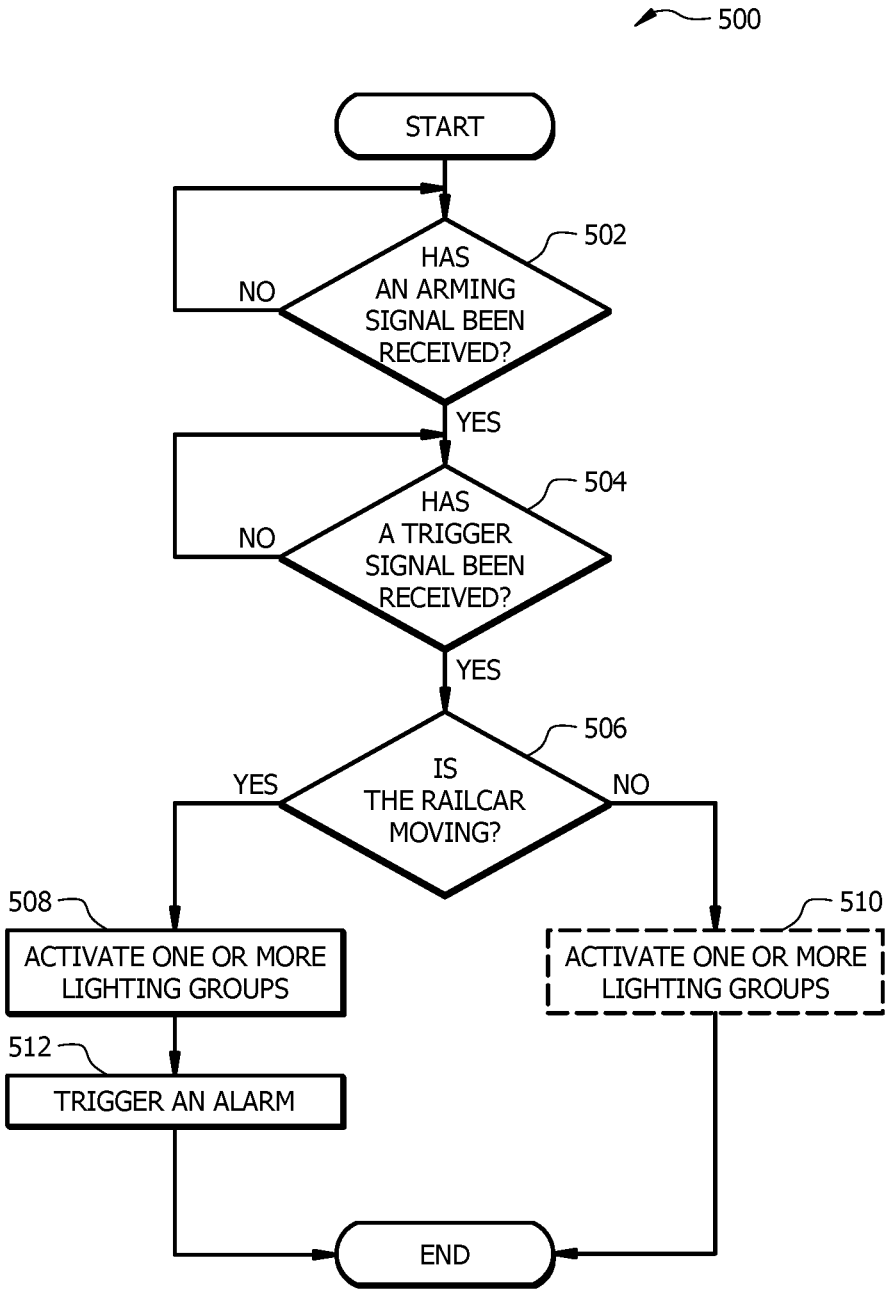
FIG. 5 is a flowchart of another embodiment of a railcar security method using the railcar security system.

FIG. 5 is a flowchart of another embodiment of a railcar security method 500 using the railcar security system 100. In an embodiment, the railcar security system 100 may employ method 500 to detect and record abnormal conditions for a railcar 200. For example, the railcar security system 100 may employ method 500 to detect abnormal conditions while the railcar 200 is moving and to record information about the detected abnormal condition.

At step 502, the controller 102 determines whether an arming signal 105 has been received. The controller 102 arms the railcar security system 100 in response to receiving the arming signal 105. Arming the railcar security system 100 configures the railcar security system 100 for detecting abnormal conditions on the railcar 200 similarly to as previously described. The controller 102 may determine whether the arming signal 105 has been received similarly to as described with respect to step 402 of method 400. The controller 102 proceeds to step 504 when the controller 102 determines that the controller 102 has received the arming signal 105. Otherwise, the controller 102 may continue to wait until the controller 102 receives the arming signal 105.

At step 504, the controller 102 determines whether a trigger signal 107 has been received from one or more of the sensors 106. The controller 102 may determine whether a trigger signal has been received similarly to as described with respect to step 404 of method 400. The controller 102 proceeds to step 506 when the controller 102 determines that the controller 102 has received the trigger signal 107. In some embodiments, the controller 102 may be configured to receive more than one trigger signals 107 before proceeding to step 506. Otherwise, the controller 102 may continue to wait until the controller 102 receives the trigger signal 107.

At step 506, the controller 102 determines whether the railcar 200 is moving. In one embodiment, the controller 102 may determine whether the railcar 200 is moving using accelerometer 124. The accelerometer 124 may indicate movement of the railcar 200 and/or the direction of movement, for example, in a direction along a railroad track. In another embodiment, the controller 102 may determine whether the railcar 200 is moving using the GPS sensor 135. For example, the controller 102 may determine that the railcar 200 in moving in response to changes in the geographic position of the railcar 200. Alternative, the controller 102 may determine whether the railcar is moving using any other suitable techniques as would be appreciated by one of ordinary skill in the art upon viewing this disclosure. The controller 102 proceeds to step 508 when the controller 102 determines that the railcar 200 is moving. Otherwise, the controller 102 may proceed to step 510 when the controller determines that the railcar 200 is not moving.

At step 508, the controller 102 activates one or more lighting groups 108 in response to the controller 102 receiving the trigger signal 107 and determining that the railcar 200 is moving. For example, the controller 102 may send an activation signal 109 to the one or more lighting groups 108 on the interior and/or the exterior of the railcar 200 in response to receiving the trigger signal 107. The one or more lighting groups 108 may activate (e.g. illuminate) in response to receiving the activation signal 109 from the controller 102. In one embodiment, the controller 102 may be configured to send an activation signal 109 that strobes or flashes the one or more lighting groups 108.

At step 512, the controller 102 triggers an alarm in response the controller 102 receiving the trigger signal 107 and determining that the railcar 200 is moving. For example, the controller 102 may send an alert signal 111 to trigger an alarm or notify personnel. In one embodiment, the alert signal 111 may be used to trigger an audible alarm or siren. In another embodiment, the alert signal 111 may be used to trigger the communication devices 112 to send a signal (e.g. wireless signal) or message to personnel. For instance, the communication devices 112 may send a signal to a control panel that notifies personal that an abnormal condition has been detected. In an embodiment, the controller 102 may be configured to record abnormal conditions. For example, the controller 102 may set and store status codes or an identifiers that identify the abnormal conditions that were detected. The controller 102 may also record the location of the railcar using the GPS sensor 135 and/or time of the detected abnormal condition.

Returning to step 506, the controller 102 may proceed to step 510 when the controller determines that the railcar 200 is not moving. At step 510, the controller 102 sends an activation signal 109 to activate one or more lighting groups 108 in response to the controller 102 receiving the trigger signal 107. The controller 102 may activate the one or more lighting groups 108 to indicate that an abnormal condition has been detected, but may not trigger an alarm. Since the railcar 200 is not moving, workers may be working on the railcar 200 and already aware of the abnormal condition. In some embodiments, step 510 may be optional and omitted. For example, the controller 102 may do nothing in response to the controller 102 receiving the trigger signal 107 when the railcar 200 is not moving.

Figure 6:
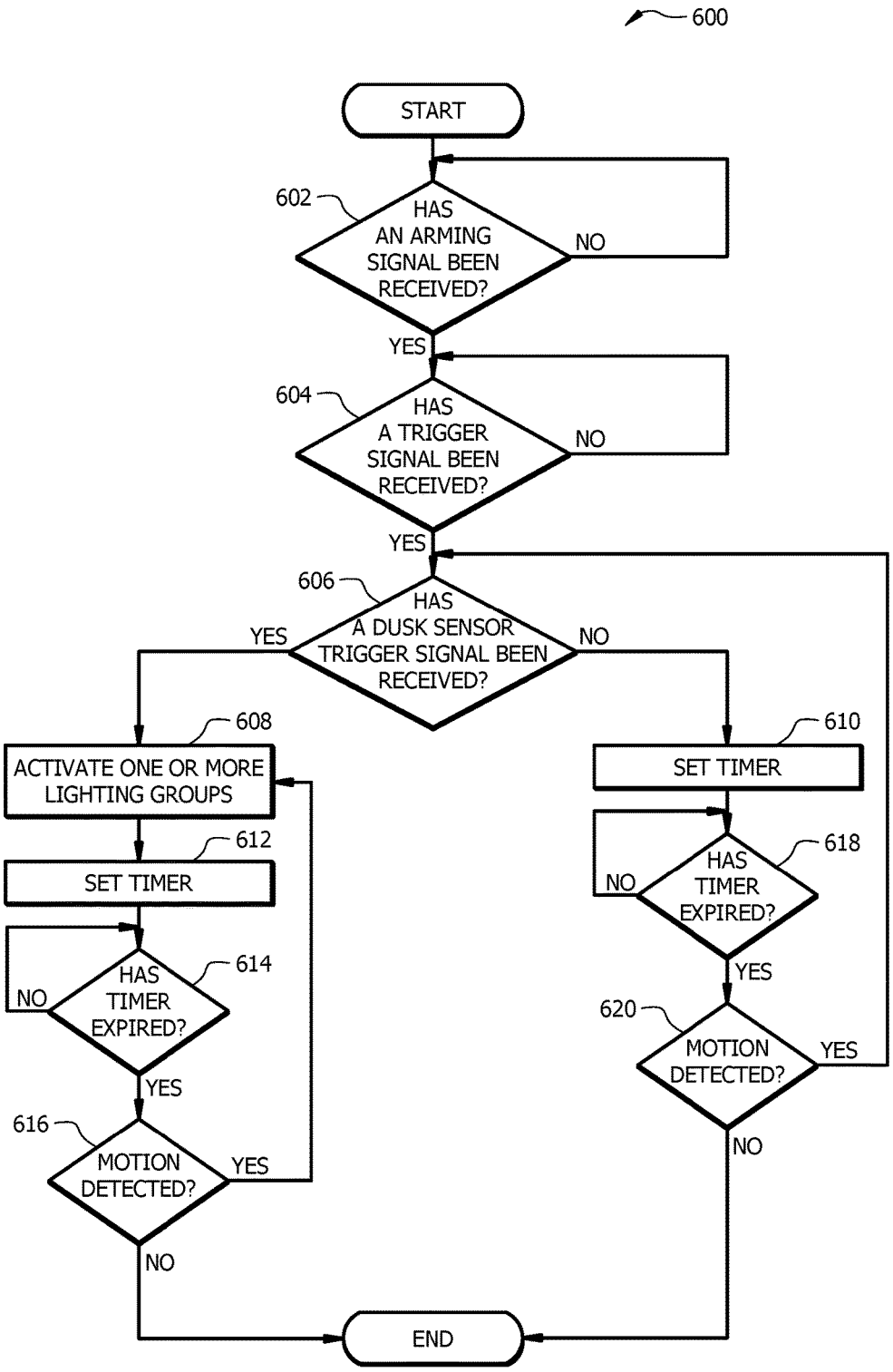
FIG. 6 is a flowchart of an embodiment of a railcar lighting method using the railcar security system.

FIG. 6 is a flowchart of an embodiment of a railcar lighting method 600 using the railcar security system 100. In an embodiment, the railcar security system 100 may employ method 600 to provide light for workers and personnel. For example, he railcar security system 100 may employ method 600 to provide light to work areas of the railcar 200 in response to detecting that workers are working at night.

At step 602, the controller 102 determines whether an arming signal 105 has been received. The controller 102 may arm the railcar security system 100 in response to receiving the arming signal 105. Arming the railcar security system 100 may configure the railcar security system 100 for providing light to work areas of the railcar 200. The controller 102 may determine whether the arming signal 105 has been received similarly to as described with respect to step 402 of method 400. The controller 102 proceeds to step 604 when the controller 102 determines that the controller 102 has received the arming signal 105. Otherwise, the controller 102 may continue to wait until the controller 102 receives the arming signal 105.

At step 604, the controller 102 determines whether a trigger signal 107 has been received. The controller 102 may determine whether a trigger signal 107 has been received similarly to as described with respect to step 404 of method 400. The controller 102 proceeds to step 606 when the controller 102 determines that the controller 102 has received the trigger signal 107. In some embodiments, the controller 102 may be configured to receive more than one trigger signal 107 before proceeding to step 606. Otherwise, the controller 102 may continue to wait until the controller 102 receives the trigger signal 107.

At step 606, the controller 102 determines whether a trigger signal 107 from the dusk sensor 126 has been received. For example, the controller 102 determines whether the controller 102 has received a first trigger signal 107 from one or more of the sensors 106 and a second trigger signal 107 from the dusk sensor 126. The first trigger signal 107 and the second trigger signal 107 from the dusk sensor 126 may be received in any order. The controller 102 may receive the trigger signal 107 from the dusk sensor 126 in response to the dusk sensor 126 detecting that the ambient light is below a predetermined threshold hold. In other words, the dusk sensor 126 may send the trigger signal 107 in response to determining that there is very little light available or that it is night time. The controller 102 proceeds to step 608 when the trigger signal 107 from the dusk sensor 126 has been received. Otherwise, the controller 102 may proceed to step 610 when the trigger signal 107 from the dusk sensor 126 has not been received.

At step 608, the controller 102 activates one or more lighting groups 108 in response to the controller receiving the trigger signal 107 from the dusk sensor 126. For example, the controller 102 may send an activation signal 109 to one or more lighting groups 108 on the interior and/or exterior of the railcar 200 in response to receiving the trigger signal 107 from the dusk sensor 126. The one or more lighting groups 108 may activate (e.g. illuminate) in response to receiving the activation signal 109 from the controller 102.

At step 612, the controller 102 sets the timer 114. The controller 102 may monitor the activity on or around the railcar 200 by setting the timer 114 with some predetermined amount of time value. The controller 102 sets the timer 114 based on how frequently the controller 102 wants to check for activity on or around the railcar 200. For example, timer 114 may be configured as a countdown timer and the controller 102 may check for activity every time the timer 114 expires. In other examples the timer 114 may be configured as a time elapsed counter and the controller 102 may check for activity every time the timer 114 reaches a predetermined amount of elapsed time that is set by the controller 102.

At step 614, the controller 102 determines whether the timer 114 has expired. The controller 102 proceeds to step 616 when the timer 114 has expired. Otherwise, the controller 102 may continue to wait and check whether the timer 114 has expired.

At step 616, the controller 102 determines whether motion is detected. The controller 102 may receive a trigger signal 107 from a motion sensor 122 in response to a motion sensor 122 detecting motion within the interior and/or the exterior of the railcar 200. For example, the motion sensor 122 may be configured to detect workers moving around or within the railcar 200 and to send a trigger signal 107 in response to detecting the workers. The controller 102 may terminate method 600 when motion is not detected. Otherwise, the controller 102 may return to step 608 when motion is detected. Returning to step 608 allows the controller 102 to reset the timer 114 and to continue providing light while workers or personnel are present.

Returning to step 606, the controller 102 may proceed to step 610 when the trigger signal 107 from the dusk sensor 126 has not been received. At step 610, the controller 102 sets the timer 114. The controller 102 may set the timer 114 similarly to as described in step 612.

At step 618, the controller 102 determines whether the timer 114 has expired. The controller 102 proceeds to step 620 when the timer 114 has expired. Otherwise, the controller 102 may continue to wait and check whether the timer 114 has expired.

At step 620, the controller 102 determines whether there is motion detection. The controller 102 may determine whether there is motion detected similarly to as described in step 616. The controller 102 may terminate method 600 when motion is not detected. Otherwise, the controller 102 may return to step 606 when motion is detected. Returning to step 606 allows the controller 102 to determine whether the ambient light conditions have changed and whether one or more lighting groups 108 should be activated to provide light to workers and personnel.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. §112(f) as it exists on the date of filing hereof unless the words "means for" or "step for" are explicitly used in the particular claim.

The invention claimed is:

1. A railcar security system comprising:

a railcar;

a plurality of sensors disposed on the railcar comprising:

a first sensor having a first sensor type and a first sensor location with respect to the railcar, and a second sensor having a second sensor type and a second sensor location with respect to the railcar;

a plurality of lighting groups disposed on the railcar comprising:

a first lighting group linked with the first sensor, and a second lighting group linked with the second sensor; and a controller disposed on the railcar, the controller operably coupled to the plurality of sensors and the plurality of lighting groups and configured to:

receive an arming signal indicating to monitor signals from the plurality of sensors;

receive a trigger signal indicating a sensor of the plurality of sensors has been triggered;

determine a sensor type for the sensor based on the trigger signal in response to receiving the trigger signal;

determine a sensor location for the sensor based on the trigger signal in response to receiving the trigger signal;

compare the determined sensor type to the first sensor type and the second sensor type;

compare the determined sensor location to the first sensor location and the second sensor location;

activate the first lighting group when the determined sensor type is the same as the first sensor type and the determined sensor location is the same as the first sensor location; and activate the second lighting group when the determined sensor type is the same as the second sensor type and the determined sensor location is the same as the second sensor location.

2. The system of claim 1, wherein the controller is configured to:

determine whether the railcar is moving when the trigger signal is received; and transmit an alert signal in response to receiving the trigger signal when the railcar is moving.

3. The system of claim 1, wherein:

the plurality of sensors comprises a global positioning system (GPS) sensor; and the controller is configured to record the location of the railcar using the GPS sensor in response to receiving the trigger signal.

4. The system of claim 1, further comprising a ventilation system disposed on the railcar, wherein:

the controller configured to determine the sensor type for the sensor comprises the controller determining the sensor is a smoke detector;

the controller configured to determine the sensor location for the sensor comprises the controller determining the sensor is located in the interior of the railcar; and the controller is configured to activate the ventilation system in response to the controller determining the sensor is a smoke detector and determining the sensor is located in the interior of the railcar.

5. The system of claim 1, wherein the controller configured to receive the trigger signal from the sensor comprises the controller configured to receive a signal from an occupancy sensor in response to detecting an object.

6. The system of claim 1, wherein the controller configured to receive the trigger signal from the sensor comprises the controller configured to receive a signal from a door switch in response to an open door.

7. The system of claim 1, wherein the controller configured to receive the trigger signal from the sensor comprises the controller configured to receive a signal from a sensor in response to the railcar disconnecting from a tie down.

8. A railcar security method comprising:

receiving, at a controller, an arming signal indicating to monitor signals from a plurality of sensors disposed on a railcar;

receiving, at the controller, a trigger signal indicating a sensor of the plurality of sensors has been triggered;

determining, by the controller, a sensor type for the sensor based on the trigger signal in response to receiving the trigger signal;

determining, by the controller, a sensor location for the sensor based on the trigger signal in response to receiving the trigger signal, the sensor location indicating the location of the sensor with respect to the railcar;

comparing, by the controller, the determined sensor type to a first sensor type of a first sensor from the plurality of sensors and a second sensor type of a second sensor from the plurality of sensors;

comparing, by the controller, the determined sensor location to a first sensor location of the first sensor and a second sensor location of the second sensor;

activating, by the controller, a first lighting group linked with the first sensor from a plurality of lighting groups disposed on the railcar when the determined sensor type is the same as the first sensor type and the determined sensor location is the same as the first sensor location; and activating, by the controller, a second lighting group linked with the second sensor from the plurality of lighting groups disposed on the railcar when the determined sensor type is the same as the second sensor type and the determined sensor location is the same as the second sensor location.

9. The method of claim 8, further comprising:

determining, by the controller, whether the railcar is moving when the trigger signal is received; and transmitting, by the controller, an alert signal in response to receiving the trigger signal when the railcar is moving.

10. The method of claim 8, further comprising recording, by the controller, the location of the railcar in response to the trigger signal, wherein the plurality of sensors comprises a global positioning system (GPS) sensor.

11. The method of claim 8, further comprising activating, by the controller, a ventilation system in response to determining the sensor is a smoke detector and determining the sensor is located in the interior of the railcar.

12. The method of claim 8, wherein receiving the trigger signal from the sensor comprises receiving a signal from an occupancy sensor in response to detecting an object.

13. The method of claim 8, wherein receiving the trigger signal from the sensor comprises receiving a signal from a door switch in response to an open door.

14. The method of claim 8, wherein receiving the trigger signal from the sensor comprises receiving a signal from a sensor in response to the railcar disconnecting from a tie down.

15. An apparatus comprising:

a plurality of sensors configured to be disposed on a railcar, comprising:

a first sensor having a first sensor type and a first sensor location with respect to the railcar, and a second sensor having a second sensor type and a second sensor location with respect to the railcar;

a plurality of lighting groups configured to be disposed on the railcar, comprising:

a first lighting group linked with the first sensor, and a second lighting group linked with the second sensor; and a controller operably coupled to the plurality of sensors and the plurality of lighting groups and configured to:

receive an arming signal indicating to monitor signals from the plurality of sensors;

receive a trigger signal indicating a sensor of the plurality of sensors has been triggered;

determine a sensor type for the sensor based on the trigger signal in response to receiving the trigger signal;

determine a sensor location for the sensor based on the trigger signal in response to receiving the trigger signal;

compare the determined sensor type to the first sensor type and the second sensor type;

compare the determined sensor location to the first sensor location and the second sensor location;

activate the first lighting group when the determined sensor type is the same as the first sensor type and the determined sensor location is the same as the first sensor location; and activate the second lighting group when the determined sensor type is the same as the second sensor type and the determined sensor location is the same as the second sensor location.

16. The apparatus of claim 15, wherein the controller is configured to:

determine whether the railcar is moving when the trigger signal is received; and transmit an alert signal in response to the trigger signal when the railcar is moving.

17. The apparatus of claim 15, wherein:

the plurality of sensors comprises a global positioning system (GPS) sensor; and the controller is configured to record the location of the railcar in response to the trigger signal.

18. The apparatus of claim 15, further comprising a ventilation system disposed on the railcar, wherein:

the controller configured to determine the sensor type for the sensor comprises the controller determining the sensor is a smoke detector;

the controller configured to determine the sensor location for the sensor comprises the controller determining the sensor is located in the interior of the railcar; and the controller is configured to activate the ventilation system in response to the controller determining the sensor is a smoke detector and determining the sensor is located in the interior of the railcar.

19. The apparatus of claim 15, wherein the controller configured to receive the trigger signal from sensor comprises the controller configured to receive a signal from an occupancy sensor in response to detecting an object.

20. The apparatus of claim 15, wherein the controller configured to receive the trigger signal from the sensor comprises the controller configured to receive a signal from a sensor in response to the railcar disconnecting from a tie down.

* * * * *